United States Patent [19]

Wichman et al.

[11] Patent Number: 4,713,038

[45] Date of Patent: Dec. 15, 1987

[54] MARBLE RACE GAME

[75] Inventors: William J. Wichman, Glendora, Calif.; Troup, deceased Edward M., late of Mount Baldy, Calif., by Cathryn H. Troup, executor

[73] Assignee: Discovery Toys, Inc., Pleasant Hill, Calif.

[21] Appl. No.: 752,420

[22] Filed: Jul. 5, 1985

[51] Int. Cl.[4] ..... A63H 29/08

[52] U.S. Cl. ..... 446/168; 273/86 C

[58] Field of Search ..... 446/168, 169, 170, 171, 446/172, 173, 89, 117; 273/86 C; D21/143

[56] References Cited

U.S. PATENT DOCUMENTS

| | | | |
|---|---|---|---|
| D. 208,789 | 10/1967 | Kuhn . | |
| D. 230,291 | 2/1974 | Karen . | |
| 1,714,433 | 5/1929 | Molnar | 446/168 |
| 2,102,807 | 12/1937 | Perks | 446/168 X |
| 2,729,020 | 1/1956 | Frampton | 446/168 |
| 2,838,870 | 6/1958 | Morse . | |
| 3,092,928 | 6/1963 | Geiser | 446/168 |
| 3,101,946 | 8/1963 | Ebert | 446/170 X |
| 3,946,516 | 3/1976 | Wirth . | |

FOREIGN PATENT DOCUMENTS 1405105 9/1973 United Kingdom .

OTHER PUBLICATIONS

Toys to Grow On "Build & Roll Raceway", Fall 1984 catalog.
Bear Creek "Marble Race" Fall 1984 catalog.
"Marble Magic" from Discovery Toys Catalog (Spring 1985).
Kiddiecraft Super Helta Skelta, copied from toy box.
Childcraft "Tobaga" from Childcraft Fall 1984 catalog.

*Primary Examiner*—Mickey Yu
*Attorney, Agent, or Firm*—Townsend and Townsend

[57] ABSTRACT

A marble race game includes a number of different, interconnected marble race toys so that a marble passes from the exit of one to the entrance of another, downstream race toy. All the toys keep the marble moving fast enough along their paths to be visually appealing and yet increase the time it takes to course the toy paths compared with conventional marble race toys. Several different marble race toys are used, including a funnel toy, a zig-zag toy, a J-loop toy, a paddle wheel toy, a serpentine toy and a pin deflect toy.

17 Claims, 16 Drawing Figures

MARBLE RACE GAME

BACKGROUND OF THE INVENTION

Modular marble race games have been created to allow the user to construct his or her own track or pathway along which a marble rolls. Some of the games use ramps and tubular connectors, such as U.S. Pat. No. 3,946,516 to Wirth, to permit the marble to roll from one user created course to another. In some games, such as that shown in the Wirth patent, the marble drops down the middle of the connecting tube to transfer the marble from one course to another while in others, such as shown in U.S. Pat. No. 2,838,870 to Morse, the marble drops from one ramp to another.

It has been discovered that although many of the prior art marble race games are quite enjoyable in use, they all suffer from a common shortcoming; the marble generally courses through the game quite quickly which lessens enjoyment and requires the user to continually restart marbles.

SUMMARY OF THE INVENTION

Applicant's invention is directed to a marble race game including a number of marble race toys having different configurations. All the marble race toys have a common characteristic in that they lengthen the time it takes the marble to pass through the game, compared with prior art marble race games, while maintaining acceptable marble rolling speeds. This lengthens the time it takes for each marble to course through the game.

The marble race game includes a number of modular marble race toys constructed to connect to one another so that a marble passes from the exit of one marble race toy to the entrance of another, downstream marble race toy. All the marble race toys keep the marble moving at a great enough rolling speed to maintain visual interest and yet increase the amount of time it takes to course the entire route of the game. This is done in many cases by extending the path along which the marble rolls or otherwise increasing the time it takes to traverse an entire marble race toy.

Several different marble race toys are used, including a funnel toy, a zig-zag toy, a J-loop toy, a paddle wheel toy, a serpentine toy and a pin deflect toy. All of the toys, except the funnel toy, have an entrance column defining the toy's top entrance at its upper end and a side exit, an exit column having a side entrance and a bottom exit and a channel connecting the side exit and side entrance, the side exit being at a higher elevation than the side entrance. The upper and lower ends of the entrance and exit columns are sized for mating engagement with the lower and upper ends of the entrance and exit columns of other marble toys so that a ball passing from the bottom exit of one toy enters the top entrance of the toy immediately downstream.

The funnel toy has an entrance column similar to that of the other toys. In place of an exit column, it has a funnel member with a side funnel entrance and a lower, funnel exit. Only the lower funnel exit and the upper and lower ends of the entrance column can be coupled to other marble race toys. The funnel toy has a downwardly and inwardly sloping funnel surface, preferably including a lower vortex portion and an upper conical portion.

The zig-zag toy has a zig-zag channel with a number of channel segments positioned at angles to one another.

The angled channel segments are sized and oriented so that the marble caroms off the walls of the channel segments, making a clicking sound as it does. The J-loop toy includes a J-loop channel, the loop of the J encircling substantially the entire exit column. The paddle wheel toy has a scalloped shaped outer surface so to prevent marbles from jamming between two vanes of the paddle wheel.

The serpentine toy is created from a number of right and left helical segments in series, each segment extending over an arc substantially greater than 180° while continuing a constant downward path for the marble. The pin deflect toy has a generally diamond-shaped bottom and a number of upstanding pins so that the marble bounces off the pins as it moves from the side exit to the side entrance of the entrance and exit columns. The side wall surrounding the bottom is shaped to deflect the marble inwardly toward the pins for enhanced marble action.

The upper and lower ends of the entrance and exit columns preferably have a stepped cylindrical surface at one of the two ends for mating with the column ends of other toys. Spacer columns have an axial slot formed through the stepped cylindrical surface substantially past the step so to reduce stress concentrations when the pieces are fitted together. The side entrances and exits in the exit and entrance columns act as stress relief slots as well.

The term marble is used since marbles are often used when playing this type of game. However, the term marble shall include rolling objects other than marbles, some of which may not be spherical.

Other features and advantages of the present invention will appear from the following description in which the preferred embodiment has been set forth in detail in conjunction with the accompanying drawings.

DETAILED DESCRIPTION OF THE PREFERRED EMBODIMENT

Figure 1:
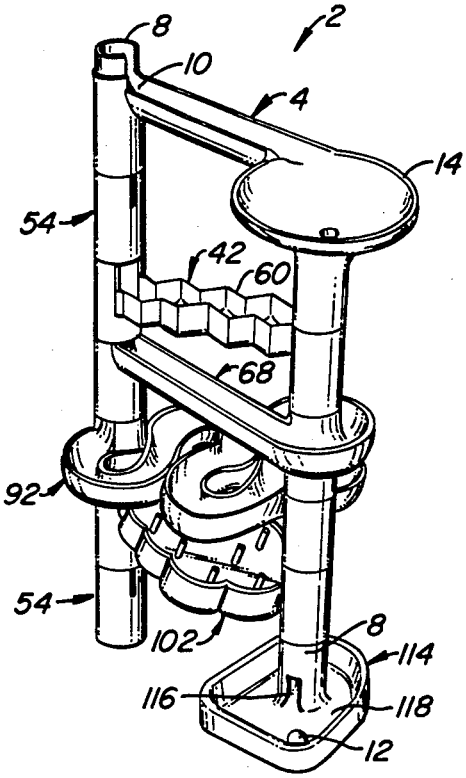
FIG. 1 is an overall perspective view of a marble race game of the invention.

Referring now to FIG. 1, a modular marble race game 2 is shown to include a number of marble race toys connected to one another at their ends.

Figure 2A:
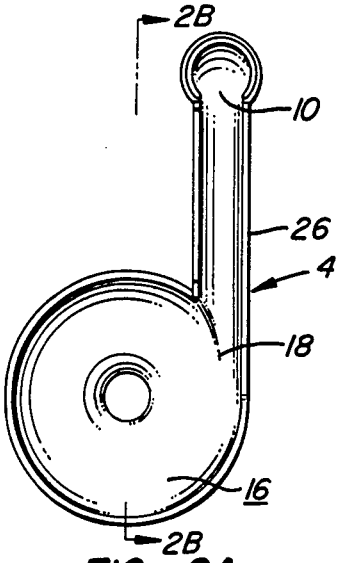
FIG. 2A is a top view of the funnel marble race toy of FIG. 1.
Figure 2B:
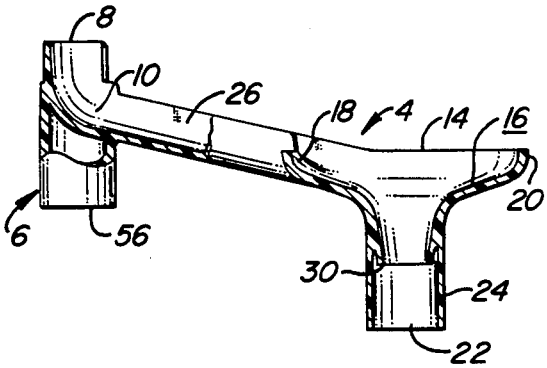
FIG. 2B is a partial cross-sectional view taken along line 2B—2B of FIG. 2A.

FIGS. 2A and 2B show a funnel marble race toy 4 and includes an entrance column 6 having a top entrance 18 and a side exit 10 along which a marble 12, seen in FIG. 1, can roll. Funnel toy 4 also includes a funnel member 14 having a funnel surface 16 with a funnel entrance 18 defined near the rim 20 of member 14. Funnel member 20 also includes a funnel exit 22 at its lower funnel end 24. Side exit 10 and funnel entrance 18 are connected by a downwardly sloping channel 26. Channel 26 directs marble 12 onto funnel surface 16 in a generally tangential direction so that the marble rolls along surface 16 in a downwardly directed spiral before exiting funnel member 14 through funnel exit 22.

Figure 2C:
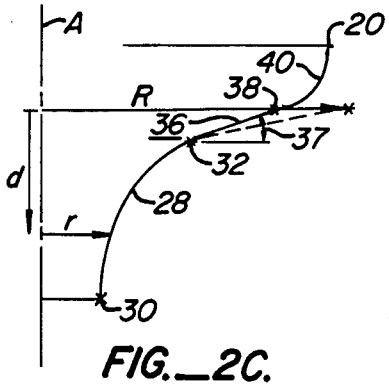
FIG. 2C schematically illustrates the contour of the funnel surface shown in FIG. 2B.

FIG. 2C illustrates the shape of surface 16. Surface 16 is a surface of revolution and includes a entire vortex curve funnel surface portion 28, extending from a spout 30 to a position 32. Vortex surface portion 28 is defined by the following formular:

$$d=K\,[(R/r)^2-1]$$

where:

R = maximum radius of the entire vortex curve at the highest point on the vortex curve;

r = radius at a given depth d along an axis A below the highest point; and

K is a constant for a chosen vortex entrance velocity.

In the preferred embodiment for a standard marble with a diameter of about 1.59 cm, the radius r at spout 30 is 0.95 cm and at position 32 is 2.44 cm. Spout 30 is 2.56 cm below point 32. This curve is achievable when R is equal to 5.08 cm and the constant K is equal to 0.106 with d measured in centimeters.

Surface 16 also includes a conical funnel portion 36 extending upwardly and outwardly at an angle 37, equal to 20° in the preferred embodiment, from point 32 to a point 38. Point 32 is the position at which the slope of vortex curve portion 28 is equal to the slope of conical portion 36, that is 20° in the preferred embodiment. An upwardly curving lip portion 40 extends from position 38 to rim 20 of funnel member 14.

Making funnel surface 16 a dual surface including vortex portion 28 and conical portion 36 markedly enhances the ability of marble 12 to roll over surface 16 along a spiral path. It has been found that if one were to make the entire funnel surface 16 in the shape of a vortex instead of using an upper conical portion 36, the portion of funnel surface 16 past point 32 would have much less incline than 20° so that marble 12 would have a tendence to roll around funnel member 14 above point 32 until it slows down sufficiently to essentially stop its spiral motion and roll down directly through funnel exit 22. However, using conical portion 36, marble 12 enters vortes portion 28 sooner and therefore maintains a generally spiral motion throughout substantially its entire path from funnel entrance 18 to spout 30.

Figure 3A:
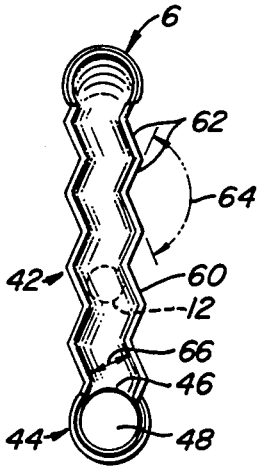
FIG. 3A is a top view of the zig-zag marble race toy of FIG. 1.
Figure 3B:
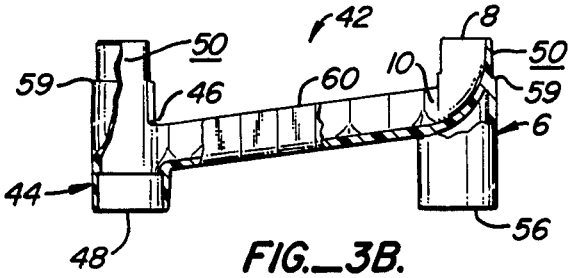
FIG. 3B is a side view of the zig-zag marble race toy of FIG. 3A with portions broken away for clarity.

Referring now to FIGS. 3A and 3B, a zig-zag marble race toy 42 is shown. Toy 42 includes an entlrance column 6 similar to entrance column 6 of funnel toy 4. Since the entrance columns in these as well as the remaining embodiments are substantially the same, the same reference numerals will be used for each. Toy 42 also includes an exit column 44 having a side entrance 46 and a bottom exit 48. The exit columns for zig-zag toy 42 and the toys described below are substantially the same so that like reference numerals will indicate like members.

Figure 8:
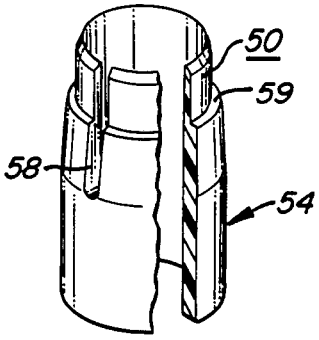
FIG. 8 is a perspective view of a spacer column showing the axial stress relieving slot.

Entrance column 6 and exit column 44 have similar stepped cylindrical surfaces 50 at their respective upper ends. These stepped cylindrical surfaces 50, shown in more detail with reference with a spacer 54 in FIG. 8, are sized for mationg engagement within funnel exit 22, bottom exit 48 and the lower, hollow ends 56 of entrance columns 6. As shown best in FIG. 8, an axial slot 58 is formed in spacer 54 to extend past shoulder 59. Slot 58 allows proper connection between the entrance and exit columns 6, 44 of the various marble race toys and spacers 54 while reducing stress concentrations which could occur if the slot only extended to about shoulder 59. Separate slots are not needed with entrance and exit columns 6, 44 since side entrances and exits 46, 10 serve the same purpose.

Zig-zag toy 42 includes a zig-zag channel 60 made up of a number of channel segments 62 oriented at a chosen angle 64 to one another. For a zig-zag channel 60 having a width 66 of 1.83 cm and using a marble having a diameter of about 1.59 cm, a range of angle 64 from 103° to 150°, and preferably about 135°, can be used. As marble 12 rolls along channel 60, it provides both a visually interesting path of motion and a pleasing clicking sound.

Figure 4A:
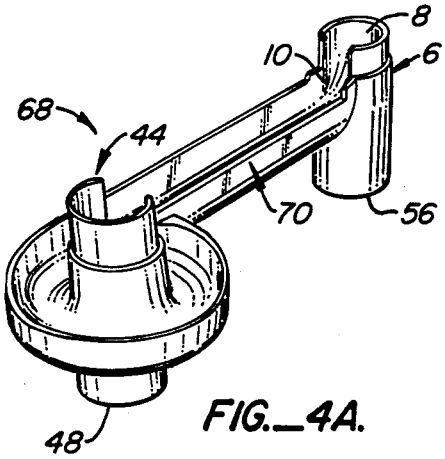
FIG. 4A is a perspective view of the J-loop marble race toy of FIG. 1.
Figure 4B:
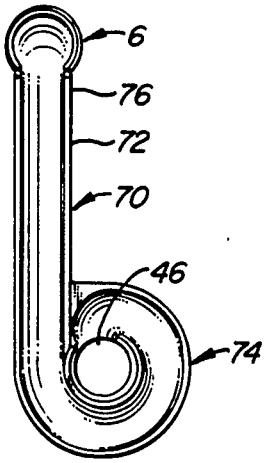
FIG. 4B is a top view of the toy of FIG. 4A.
Figure 4C:
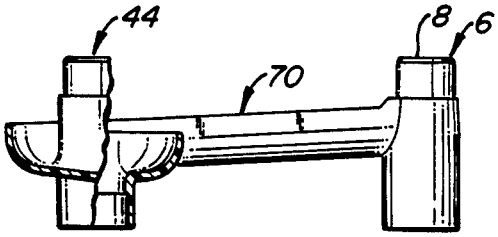
FIG. 4C is a side view of the toy of FIG. 4A with portions broken away for clarity.

Referring now also to FIGS. 4A–4C, a J-loop marble race toy 68 is illustrated. Toy 68 includes an entrance column 6 and an exit column 44 coupled by a downwardly sloping J-loop channel 70. Channel 70 includes a straight, upper section 72 and a downwardly spiraling lower section 74. Lower section 74 wraps around exit column 44 and communicates with side entrance 46 while the upper end 76 of upper section 72 communicates with side exit 10. A marble introduced through top entrance 8 rolls down upper section 72, along lower section 74 rotating about exit column 44, enters side entrance 46, drops downwardly through column 44 and exits through bottom exit 48.

Figure 5:
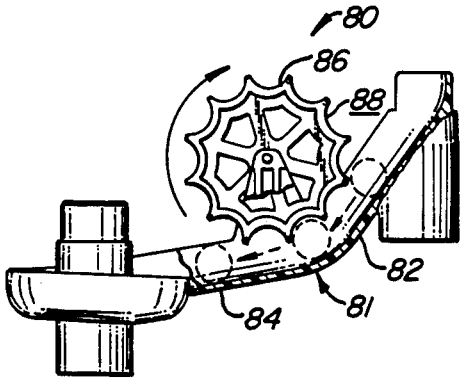
FIG. 5 is a side view of a paddle wheel marble race toy similar to the J-loop toy of FIGS. 4A–4C, but including a paddle wheel along the channel.

At FIG. 5, a paddle wheel marble race toy 80 is shown. It is similar to J-loop toy 68 of FIGS. 4A–4C, except for two modifications. First, J-channel 81 includes an upper, steeply inclined section 82 and a lower, gradually inclined section 84. Second, a paddle wheel 86 is mounted to channel 81 adjacent the intersection of sections 82 and 84. The outer surface 88 of paddle wheel 86 has a scalloped shape. The size and shape of surface 88, the position of surface 88 relative to channel 81 and size of marble 12 combine to allow marbles 12 to engage surface 88 and rotate paddle wheel 80 and yet keep marbles from jamming the paddle wheel.

Figure 6A:
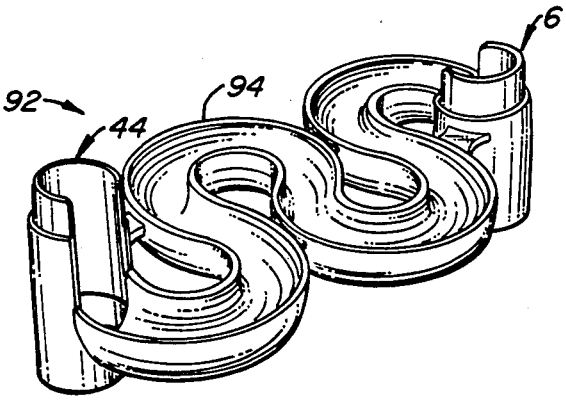
FIG. 6A is a perspective view of the serpentine marble race toy of FIG. 1.
Figure 6B:
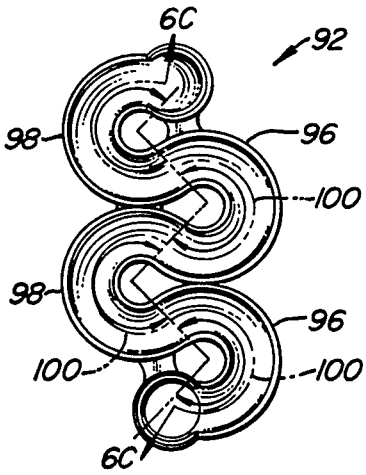
FIG. 6B is a top view of the serpentine toy of FIG. 6A.
Figure 6C:
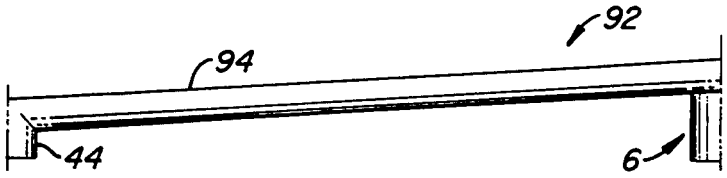
FIG. 6C is a side view taken along line 6C—6C of FIG. 6B showing the constant drop in elevation of the serpentine channel.

Turning now to FIGS. 6A–6C, a serpentine marble race toy 92 is illustrated. Toy 92 includes an entrance column 6, an exit column 44 and a serpentine channel 94 connecting the two. Serpentine channel 92 includes a number of right and left handed helical segments 96, 98, segments 96, 98 extending over angles 100 of substantially more than 180°. In the preferred embodiment, angles 100 are about 270°. Since helical segments 96, 98 continue to slope downwardly whereas circular segments would begin to slope upwardly when angle 100 exceeded 180°, an extreme serpentine path is provided with a continuing downhill slope. FIG. 6C is a cross-sectional view of FIG. 6B taken along curved line 6C—6C and illustrates the constant downward slope of serpentine channel 94.

Figure 7A:
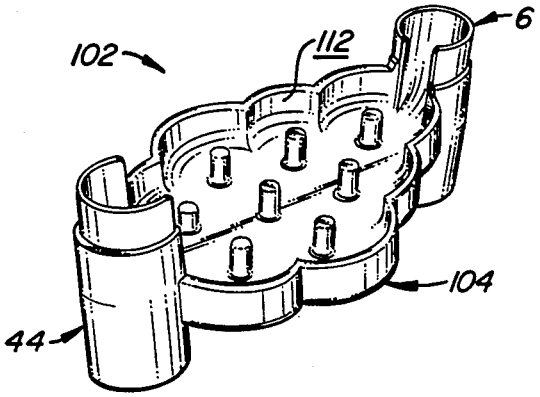
FIG. 7A is a perspective view of the pin deflect toy of FIG. 1.
Figure 7B:
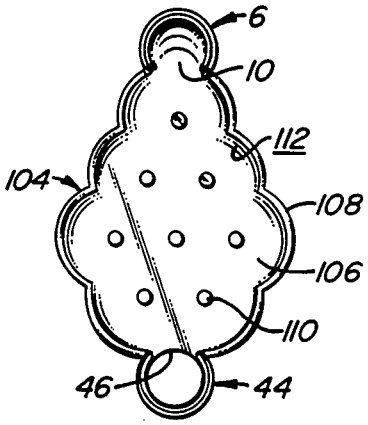
FIG. 7B is a top view of the toy of FIG. 7A.

At FIGS. 7A–7B, a pin deflect marble race toy 102 is shown. Toy 102 includes entrance and exit columns 6, 44 and a pin deflect channel 104. Channel 104 includes a generally flat, downwardly sloping diamond-shaped bottom 106 and an upwardly extending side wall 108 around the periphery of bottom 106. A number of pins 110 are strategically positioned to extend upwardly from bottom 106 so to deflect marbles as they pass from side exit 10 to side entrance 46. Side wall 108 has a generally scalloped internal surface 112 which helps deflect marbles 12 back towards pins 110 so the marbles do not merely pass from side exit 10 to side entrance 46 by skirting along side wall 108 without interacting with pins 110. Other mechanical obstructions or diverters, instead of scalloped surface 112, could be used to redirect marbles 12 back towards the grouping of pins 110.

In use, the user usually selects several different marble race toys and mounts them in a configuration pleasing to the user. One such configuration is shown in FIG. 1. Depending upon the marble race toy, one or more spacers 54 may be needed. Note that each of the marble race toys with the exception of funnel toy 4 can be mounted below or above the other marble race toys. However, the use of funnel toy 4 is somewhat restricted since the nature of the toy eliminates mounting in any entrance columns over funnel member 14. Thus, funnel toy will often be chosen as the upper most marble race toy. However, if a game including three or more sets of columns, instead of the two column game shown in FIG. 1, is constructed, the entrance column 6 of a funnel marble race toy 4 may be used below the exit column 44 of another toy. However, funnel 14 will be the top member of any column set.

Referring now to the embodiment of FIG. 1, the user drops a marble in top entrance 8, which is directed out side exit 10, along channel 26 and through funnel entrance 18 in a generally tangential (that is non-radial) direction. Marble 12 rolls around funnel surface 16 spiraling downwardly until it passes through funnel exit 22 and into the top entrance 8 of zig-zag marble race toy 42. The marble passes along zig-zag channel 60 and then drops down through the exit column 44 of toy 42 and into the entrance column 6 of J-loop toy 68. The marble continues in this manner passing through serpentine toy 92 and pin deflect toy 102 until it passes through the top entrance 8 of a marble collection base 114 (seen in FIG. 1) and out a side exit 116 for collection in a marble reservoir 118 of base 114. User then picks up marble 12 and repeats the process.

Each of the marble race toys slows down the traverse of marble 12 through the toy and still provides sufficient motion, both speed and path shape, to please the user.

Modification and variation can be made to the disclosed embodiment without departing from the subject of the invention as defined in the following claims.

We claim:

1. A modular marble race game made of a number of marble race toys comprising:

entrance columns each having upper and lower ends, a top entrance at the entrance column upper end and a side exit;

exit columns each having upper and lower ends, a side entrance and a bottom exit at the exit column lower end, the side exit positioned at a higher elevation than the side entrance;

the upper ends of the entrance and exit columns of one of said toys sized for mating engagement with the respective lower ends of the exit and entrance column of another of said toys;

a zig-zag channel connecting the side exit of a first entrance column with the side entrance of a first exit column to constitute a zig-zag toy, the channel including a number of channel segments positioned at angles to adjacent channel segments to define a zig-zag marble path;

a J-channel connecting the side exit of a second entrance column with the side entrance of a second exit column to constitute a J-channel toy, the J-channel including a first, elongate portion extending from the second entrance column side exit and a second, spiral portion circumscribing a substantial portion of the second exit column and opening into its side entrance;

a paddle wheel channel connecting the side exit of a third entrance column with the side entrance of a third exit column;

a rotatable paddle wheel mounted to the paddle wheel channel to constitute a paddle wheel toy, the paddle wheel having an outer surface positioned adjacent a portion of the paddle wheel channel to engage the marble as the marble rolls along the paddle wheel channel to rotate the paddle wheel, the outer paddle wheel surface having a scalloped shape;

a serpentine channel connecting the side exit of a fourth entrance column and the side entrance of a fourth exit column to constitute a serpentine channel toy, the serpentine channel including a plurality of alternating right and left helical segments defining arcs of substantially greater than 180° while maintaining a generally constant downward slope;

a wide, pin-deflect channel connecting the side exit of a fifth entrance column and the side entrance of a fifth exit column constituting a pin-deflect toy, the pin-deflect channel having a bottom, a sidewall and a plurality of upwardly extending pins mounted to the bottom, a first bottom portion at the fifth entrance column side exit and a second, laterally contracting bottom portion at the fifth exit colunn side entrance, at least a portion of the sidewall having an irregular inner sidewall surface to deflect the marble away from the sidewall as the marble rolls along the channel;

a funnel member having a sidewall defining an inwardly and downwardly tapering inner funnel surface extending between an upper rim and a lower funnel end, the lower funnel end being at a downwardly opening funnel exit, the sidewall having a funnel entrance towards the upper rim;

a funnel toy channel connecting the side exit of a sixth entrance column to the funnel entrance to constitute a funnel toy, the funnel toy channel defining a generally tangential funnel entrance path along which the marble rolls as it enters the funnel; and the lower funnel end of the funnel member sized for mating engagement with upper ends of the entrance columns of at least one other of said toys.

2. The game of claim 1 wherein the funnel surface include a conical surface portion above a vortex surface portion.

3. A marble race toy comprising:

an entrance column having upper and lower ends, a top entrance at the entrance column upper end and a side exit;

an exit column having upper and lower ends, a side entrance and a bottom exit at the exit column lower end, the side exit positioned at a higher elevation than the side entrance;

the upper ends of the entrance and exit columns of said toy sized for mating engagement with the respective lower ends of the exit and entrance columns of another toy having the same exit and entrance column lower end structure; and a J-channel connecting the side exit with the side entrance, the channel including a first, elongate portion extending from the side exit and a second, spiral portion circumsribing a substantial portion of the exit column and opening into the side entrance.

4. The toy of claim 3 wherein the first portion is straight.

5. The toy of claim 3 further comprising:

a rotatable paddle wheel, mounted to the first channel portion, having an outer surface positioned adjacent the first channel portion to engage the marble as the marble rolls along the first channel portion to rotate the paddle wheel, the outer paddle wheel surface sized to accept a single marble.

6. The toy of claim 5 wherein the first channel portion includes first and second sub-portions, the first sub-portion extending from the side exit and having a steeper slope than the second sub-portion.

7. A marble race toy comprising:

an entrance column having upper and lower ends, a top entrance at the entrance column upper end and a side exit;

an exit column having upper and lower ends, a side entrance and a bottom exit at the exit column lower end, the side exit positioned at a higher elevation than the side entrance;

the upper ends of the entrance and exit columns of said toy sized for mating engagement with the respective lower ends of the exit and entrance columns of another toy having the lower same exit and entrance column lower end struture; and a serpentine channel connecting the side exit and the side entrance and including a plurality of alternating right and left helical segments defining arcs of substantially greater than 180° while maintaining a generally constant downward slope.

8. The toy of claim 7 wherein the arcs are about 270°.

9. A marble race game including marble race toys comprising:

entrance columns each having upper and lower ends, a top entrance at the entrance column upper end and a side exit;

exit columns each having upper and lower ends, a side entrance and a bottom exit at the exit column lower end, the side exit positioned at a higher elevation than the side entrance;

the upper ends of the entrance and exit columns of one of said toys sized for mating engagement with the respective lower ends of the exit and entrance columns of another of said toys;

a J-channel connecting the side exit of a first entrance column with the side entrance of a first exit column to constitute a J-channel toy, the J-channel including a first, elongate portion extending from the side exit of the first column entrance and a second, spiral portion circumscribing a substantial portion of the first exit column and opening into the side entrance of the first exit column; and a wide, pin-deflect channel, connecting the side exit of a second entrance column and the side entrance of a second exit column constituting a pin-deflect toy having a bottom, a sidewall and a plurality of upwardly extending pins mounted to the bottom, a first bottom portion at the second entrance column side exit and a second, laterally contracting bottom portion at the second entrance column side entrance, at least a portion of the sidewall having an irregular inner sidewall surface to deflect the marble away from the sidewall as the marble rolls along the channel.

10. The game of claim 9 wherein the inner sidewall surface has a scalloped shape.

11. The game of claim 9 wherein the bottom is generally diamond-shaped.

12. A marble race game including marble race toys comprising:

entrance columns each having upper and lower ends, a top entrance at the entrance column upper end and a side exit;

exit columns each having upper and lower ends, a side entrance and a bottom exit at the exit column lower end, the side exit positioned at a higher elevation than the side entrance;

a J-channel connecting the side exit of a first entrance cclumn with the side entrance of a first exit column to constitute a J-channel toy, the J-channel including a first, elongate portion extending from the side exit of the first entrance column and a second, spiral portion circumscribing a substantial portion of the first exit column and opening into the side entrance of the first exit column; and a funnel member having a sidewall defining an inwardly and downwardly tapering inner funnel surface extending between an upper rim and a lower funnel end, the lower funnel end being at a downwardly opening funnel exit, the sidewall having a funnel entrance towards the upper rim;

the funnel surface including an upper conical surface portion and a lower vortex shaped surface portion;

a funnel toy channel connecting the side exit of a second entrance column to the funnel entrance to constitute a funnel toy, the funnel toy channel defining a generally tangential funnel entrance path along which the marble rolls as it enters the funnel; and the upper ends of the entrance and exit columns of one of said toys sized for mating engagement with the respective lower ends of the exit and entrance column of another of said toys.

13. The game of claim 12 wherein the vortex shaped surface portion is defined by the following formula:

$$d = K\,[(R/r)^2 - 1]$$

where: R = maximum radius of the entire vortex curve at the highest point on the vortex curve;

r = radius at given depth d along axis below the highest point; and

K is a constant for a chosen entrance velocity.

14. The game of claim 12 wherein the conical surface portion is inclined about 20° to the horizontal.

15. The game of claim 12 wherein one of said upper and lower portions of said entrance column comprises a stepped cylindrical outer surface, and the other of said upper and lower portions comprises a cylindrical inner surface sized for mating engagement with said stepped cylindrical outer surface.

16. The game of claim 21 further comprising a spacer column including stepped cylindrical outer surface and an axial slot extending from an upper end of the spacer column to a point past said stepped cylindrical outer surface.

17. A marble race game including marble race toys comprising:

entrance columns each having upper and lower ends, a top entrance at the entrance column upper end and a side exit;

exit columns each having upper and lower ends, a side entrance and a bottom exit at the exit column lower end, the side exit positioned at a higher elevation than the side entrance;

a serpentine channel connecting the side exit of a first entrance column and the side entrance of a first exit column to constitute a serpentine channel toy, the serpentine channel including a plurality of alternating right and left helical segments defining arcs of substantially greater than 1800, while maintaining a generally constant downward slope;

a funnel member having a sidewall defining an inwardly and downwardly tapering inner funnel surface extending between an upper rim and a lower funnel end, the lower funnel end being at a downwardly opening funnel exit, the sidewall having a funnel entrance towards the upper rim;

the funnel surface including an upper conical surface portion and a lower vortex shaped surface portion;

a funnel toy channel connecting the side exit of a second entrance column to the funnel entrance to constitute a funnel toy, the funnel toy channel defining a generally tangential funnel entrance path along which the marble rolls as it enters the funnel; and the upper ends of the entrance and exit columns of one of said toys sized for mating engagement with the respective lower ends of the exit and entrance column of another of said toys.

* * * * *